US007262950B2

(12) United States Patent
Suzuki et al.

(10) Patent No.: US 7,262,950 B2
(45) Date of Patent: Aug. 28, 2007

(54) RELAY DEVICE HAVING HOLDING CURRENT STABILIZING AND LIMITING CIRCUIT

(75) Inventors: Hirohisa Suzuki, Nishio (JP); Koichi Sato, Anjo (JP); Koichi Tsukada, Okazaki (JP); Manabu Morita, Okazaki (JP); Yoshifuru Nishino, Chiryu (JP)

(73) Assignees: Anden Co., Ltd., Anjo (JP); Denso Corporation, Kariya (JP)

( * ) Notice: Subject to any disclaimer, the term of this patent is extended or adjusted under 35 U.S.C. 154(b) by 0 days.

(21) Appl. No.: 11/007,630

(22) Filed: Dec. 9, 2004

(65) Prior Publication Data

US 2005/0135040 A1 Jun. 23, 2005

(30) Foreign Application Priority Data

Dec. 11, 2003 (JP) ..... 2003-413742
Sep. 21, 2004 (JP) ..... 2004-273898

(51) Int. Cl.
*H01H 47/04* (2006.01)
*H01H 47/22* (2006.01)

(52) U.S. Cl. ..... 361/139; 361/144; 361/152; 361/154; 361/194; 361/160

(58) Field of Classification Search ..... 361/140, 361/142, 154, 139, 144, 152, 160, 194
See application file for complete search history.

(56) References Cited

U.S. PATENT DOCUMENTS 2,991,407 A * 7/1961 Murphy ..... 323/273
3,777,252 A * 12/1973 Leszke ..... 323/267
4,266,261 A * 5/1981 Streit et al. ..... 361/154
5,812,355 A * 9/1998 Nojima ..... 361/152
6,414,576 B1 * 7/2002 Nakamura et al. ..... 335/83
6,514,091 B2 * 2/2003 Saito et al. ..... 439/76.2
6,686,821 B2 2/2004 Suzuki
6,943,540 B2 * 9/2005 Vincent et al. ..... 324/158.1

FOREIGN PATENT DOCUMENTS

JP 10-040792 * 2/1998
JP A-2000-83310 3/2000

OTHER PUBLICATIONS

Horowitz et al., The Art of Electronics, 1989, Cambridge University Press, pp. 88-91.*
Sedra et al., Microelectronic Circuits, 1987, Holt, Rinehart and Winston, pp. 453-455.*
The Illusttrated Dictionary of Electronics, 2001, McGraw-Hill, p. 243.*

* cited by examiner

*Primary Examiner*—Michael Sherry
*Assistant Examiner*—Z Kitov
(74) *Attorney, Agent, or Firm*—Posz Law Group, PLC

(57) ABSTRACT

A relay device includes plural relay units, each having a coil for opening/closing a contact point, a base plate made of resin and having wiring metal pieces, and a control circuit mounted on the base plate for controlling current supply to the coil. The control circuit has a function of stabilizing the holding current irrespective of environmental variation. Thus, the holding current can be further reduced and heating and power consumption can be reduced without losing the function of keeping the contact point state.

6 Claims, 7 Drawing Sheets

RELAY DEVICE HAVING HOLDING CURRENT STABILIZING AND LIMITING CIRCUIT

CROSS REFERENCE TO RELATED APPLICATION

This application is based on and incorporates herein by reference Japanese Patent Applications No. 2003-413742 filed on Dec. 11, 2003 and No. 2004-273898 filed on Sep. 21, 2004.

FIELD OF THE INVENTION

The present invention relates to a relay device, which stabilizes and limits a holding current supplied to a coil.

BACKGROUND OF THE INVENTION

A relay device achieved by modularizing plural relay units on a common wiring board (base plate) is used for a vehicle or the like, because many relays can be integrated within a small limited space. For example, U.S. Pat. No. 6,686,821B2 (JP-A-2002-343216) proposes a relay device, which uses a base plate as a wiring board. The based plate is provided by subjecting a lead-frame-shaped press-molding article using wiring metal pieces to insert resin molding. The end portions of these wiring metal pieces are bent and used as connection terminals.

Furthermore, JP-A-2000-83310 proposes a relay device in which a print board having an integrated circuit element (IC) mounted thereon is perpendicularly fixed to a base plate.

Recently, miniaturization of relay devices is more and more required, and the interval between the respective relay units in each relay device is narrowed. Therefore, coil heating caused by current supplied to respective coils affects adjacent relay units through this narrow interval or through wiring metal pieces of the base plate from the terminals.

It is difficult to radiate heat generated by the coils because each relay unit is surrounded by other relay units or the like. As a result, an increase in coil temperature substantially limits the miniaturization of the relay device. Furthermore, a power saving requirement to the relay device is more and more demanded year by year.

In order to solve this problem, it is considered that a coil-applied voltage is reduced after a contact point operation based on a current supply to coils has been completed, thereby reducing the heating of the coils. In this case, however, dispersion in the manufacturing of coils or an increase of temperature causes an increase of coil resistance. Thus, the coil-applied voltage (holding voltage) must be reduced in consideration of the increase of the coil resistance. As a result, for example, when current is supplied to only one relay unit or when the external temperature is low, and thus an increase of coil resistance is small, the holding voltage cannot be actually reduced although it is expected to be originally reduced to a lesser value.

SUMMARY OF THE INVENTION

The present invention has an object to provide a relay device, which can reduce coil heating and power consumption without losing safety of a contact point operation, so that miniaturization and weight saving can be further promoted.

In order to achieve the above object, a relay device according to one aspect of the invention has a current supply control circuit having a holding current stabilizing and limiting circuit. This circuit controls a holding current as a coil supply current of a relay unit after a contact point operation based on coil current supply is completed. Thus, the holding current is kept to a predetermined value which is smaller than an operating current that is used as the coil supply current when the contact point operation is being carried out, and is also larger than a minimum holding current value at which a relay state under a coil current supply is held.

Even when an environmental variation occurs in the holding current of coils, a power source voltage, etc., current for holding the holding current, that is, the contact point operation state is stabilized. Thus, it is unnecessary to diminish a holding current reducing margin in consideration for the environmental variation. Thus, the coil power consumption and the coil heating can be more greatly reduced without disturbing the safety of the holding operation after the contact point operation based on coil current supply is completed.

Specifically, the contact point state after the contact point operation based on the coil current supply is completed is held by keeping a magnetic flux amount substantially proportional to the coil supply current to a permissible minimum magnetic flux amount or more. That is, the coil supply current may be surely kept to a predetermined value (i.e., a proper holding current value) exceeding the minimum holding current value corresponding to the coil supply current at which the magnetic flux amount corresponds to the permissible minimum magnetic flux value. The difference between the predetermined value and the minimum holding current value corresponds to a current margin.

Accordingly, even when the resistance of a coil is varied due to external temperature or self-heating or because it is heated by adjacent coils, or even when the power source voltage is varied, the coil supply current itself is kept to the proper holding current value. Thus, the damage of coils and heating of coils can be further reduced with stably keeping the contact point state.

On the other hand, if the coil applied voltage is reduced by a predetermined rate with respect to the rated voltage thereof, the coil supply current is varied due to variation of the coil resistance which is caused by coil temperature and the coil supply current cannot be greatly reduced.

Furthermore, a relay device according to another aspect of the invention has a current supply control circuit and a refreshing circuit. The current supply control circuit has a holding power limiting circuit for controlling holding power corresponding to power to be supplied to a coil of a relay unit after a contact point operation based on coil current supply is completed. Thus, the holding power is kept to a predetermined value which is smaller than contact point operation power corresponding to power to be supplied to the coil of the relay unit when the contact point operation is being carried out and also larger than a minimum holding voltage value at which a relay state at the coil current supply time can be held. The refreshing circuit periodically increases the holding power while the holding power is supplied to the coil.

Specifically, in the relay device, in which the holding power for holding the contact point state after the contact point of the relay unit is operated (e.g., from OFF to ON) is reduced to less than the contact point operation power for the contact point operation, the contact point operating power is periodically supplied to the coil of the relay unit under a state that the contact point state (e.g., ON) is held. In order to keep the holding power for holding the contact point state to be less than the contact point operating power, the holding current may be set to a constant current smaller than a contact point operating current. Alternatively, a coil voltage applied to the coil may be simply reduced within a contact point state holding range as compared with that supplied at the contact point operation time.

Accordingly, even when the state of the contact point of the relay unit whose coil is supplied with holding power smaller than the contact point operating power transits due to some factor such as occurrence of mechanical impact or noise of the power source voltage, the contact point operating power is periodically supplied for a short time to the extent that the contact point state can be restored. Accordingly, as compared with the case where the contact point operating power is supplied to the coil of the relay unit at all times, the contact point state can be kept more stable with implementing power saving and reduction of coil heating.

Preferably, the connection of the terminal of each relay unit and the wiring metal piece and the connection of the terminal of the integrated circuit forming the holding current limiting circuit and the wiring metal piece are carried out by welding in the same direction.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Embodiment

Figure 1:
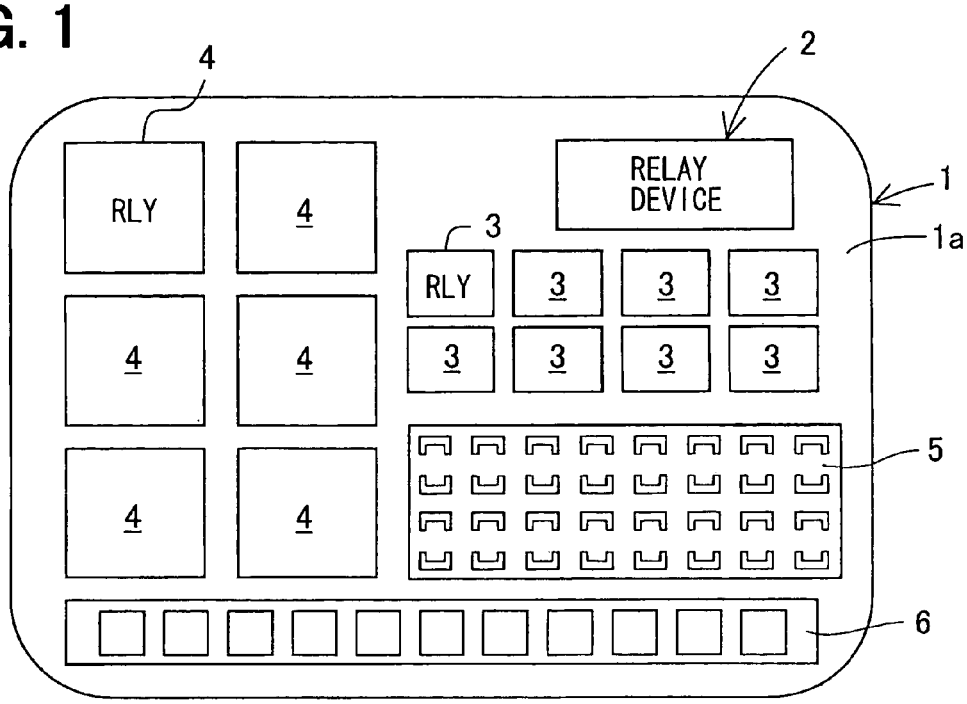
FIG. 1 is a schematic plan view showing the inner construction of a relay box on which a relay device according to an embodiment of the invention is mounted.

Referring to FIG. 1, a relay box 1 mounts, on its bottom plate 1*a*, a relay device 2, eight small-size relays 3, six large-size relays 4, a fuse table 5 and a terminal table 6 for external connection. These elements are mutually connected to one another through a bus bar (not shown).

Figure 2:
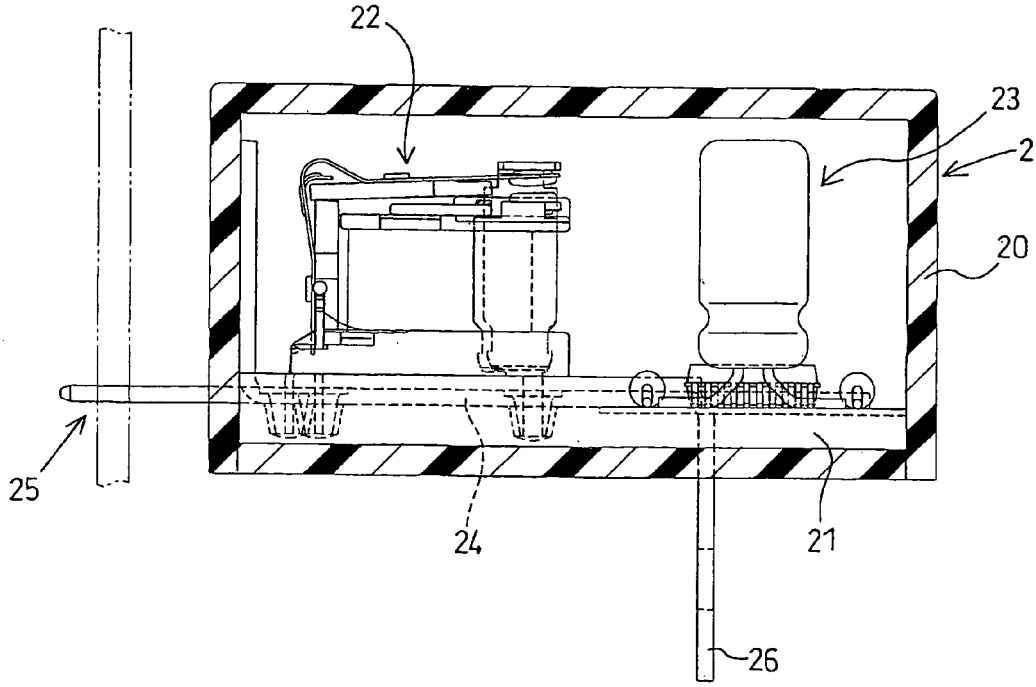
FIG. 2 is a side view of the inner construction of the relay device according to the embodiment.

As shown in FIG. 2, the relay device 2 is accommodated in a resin box 20, and a base plate 21 is fixed to the bottom surface of the resin box 20. A relay unit 22 and a control circuit 23 are mounted on the base plate 21.

The base plate 21 comprises a resin plate containing wiring metal pieces 24 which are patterned by punching. Some wiring metal pieces 24 to be connected to the relay unit 22 and the control circuit 23 are projected at desired places of the base plate 21. Some of the wiring metal pieces 24 projecting outwardly constitute terminals 25 and 26 for external connection.

Figure 3:
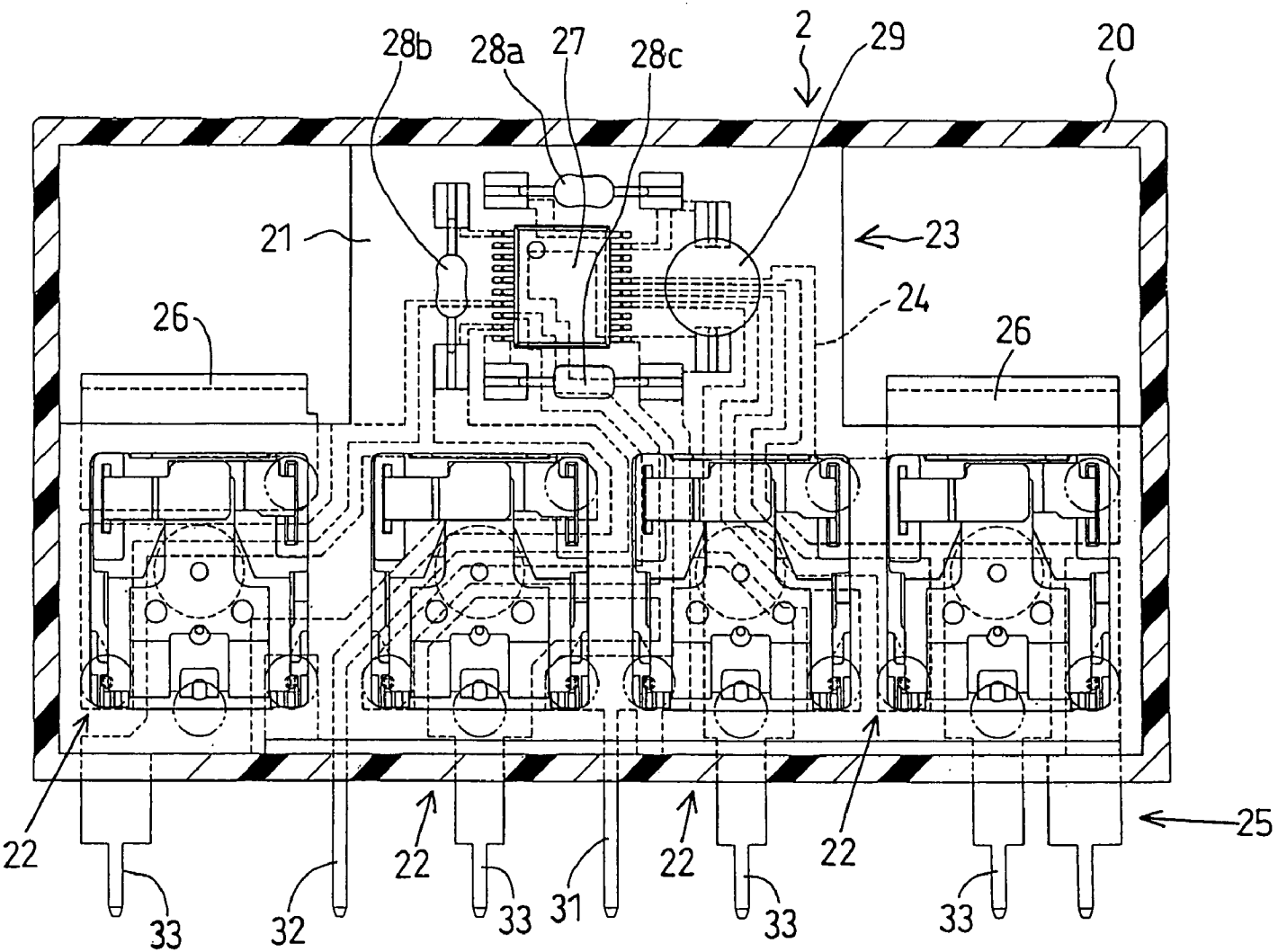
FIG. 3 is a plan view showing the inner construction of the relay device according to the embodiment.

As shown in FIG. 3, the relay device 2 has four relay units 22 arranged laterally in a line, and the control circuit 23 is disposed adjacently to one of two relay units 22 disposed at the center portion.

The control circuit 23 comprises one bipolar IC 27, external resistance elements 28*a*, 28*b*, a Zener diode 28*c* and one capacitor 29. The control circuit 23 for controlling the driving of each relay unit 22 may be modified in accordance with its application. A necessary number of tips of the wiring metal pieces 24 are perpendicularly or vertically projected from the base plate 21 around the control circuit 23. The respective terminals of the bipolar IC 27, the external resistance elements 28*a*, 28*b*, the Zener diode 28*c* and the capacitor 29 are welded to the tips of the corresponding wiring metal pieces 24. Likewise, the terminals of the respective relay units 22 are welded to the tips of the corresponding wiring metal pieces 24 projected perpendicularly from the base plate 21 around the relay units 22.

The tip portions 26 of the wiring metal pieces 24 constitute the power source terminals. The two tip portions of the wiring metal pieces 24 are arranged at right and left sides so as to be bent perpendicularly to the base plate 21. The external connection terminals 25 and 26 of the relay device 2 are connected to bus bar wires (not shown) in the resin box 20 by welding.

Figure 4:
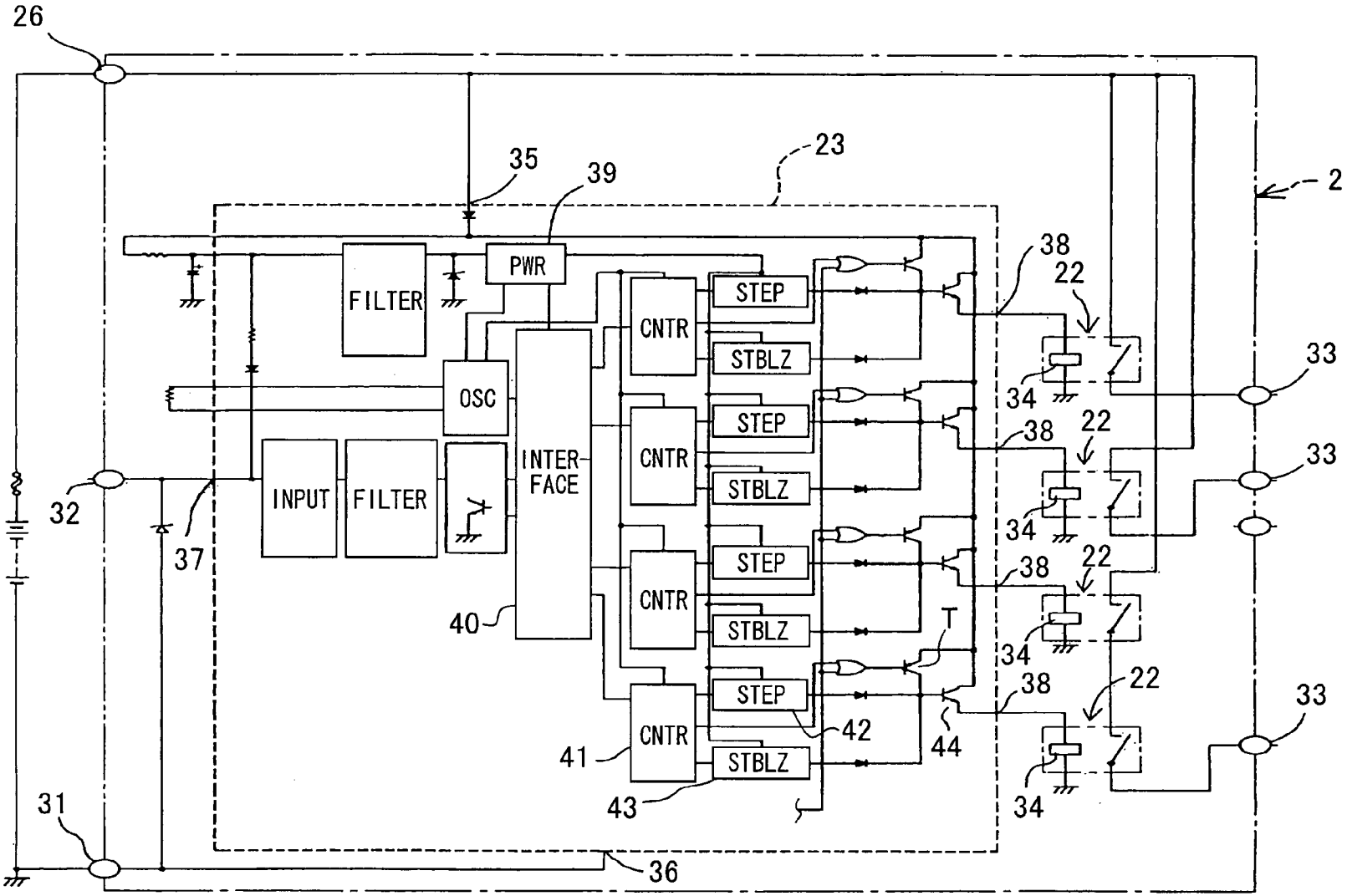
FIG. 4 is a circuit diagram showing the relay device according to the embodiment.

Next, the main part of the circuit construction of the relay device 2 will be described with reference to FIG. 4.

The relay device 2 has the power source terminals 26, a ground terminal 31, a serial signal input terminal 32 and contact point terminals 33 of the respective relay units 22. Each of the relay units 22 has one normally-open contact point and a coil 34 for driving it.

The control circuit 23 has a power source terminal 35, a ground terminal 36, a serial signal input terminal 37, coil terminals 38 connected to coils 34 of the respective relay units 22, and terminals for connection of external elements. The control circuit 23 has a constant-voltage power supply circuit 39, and a communication interface circuit 40. Furthermore, for each relay unit 22, the control circuit 23 also has a timer counter 41, a step circuit 42, a current stabilizing circuit portion 43 and a driver transistor 44.

Figure 5:
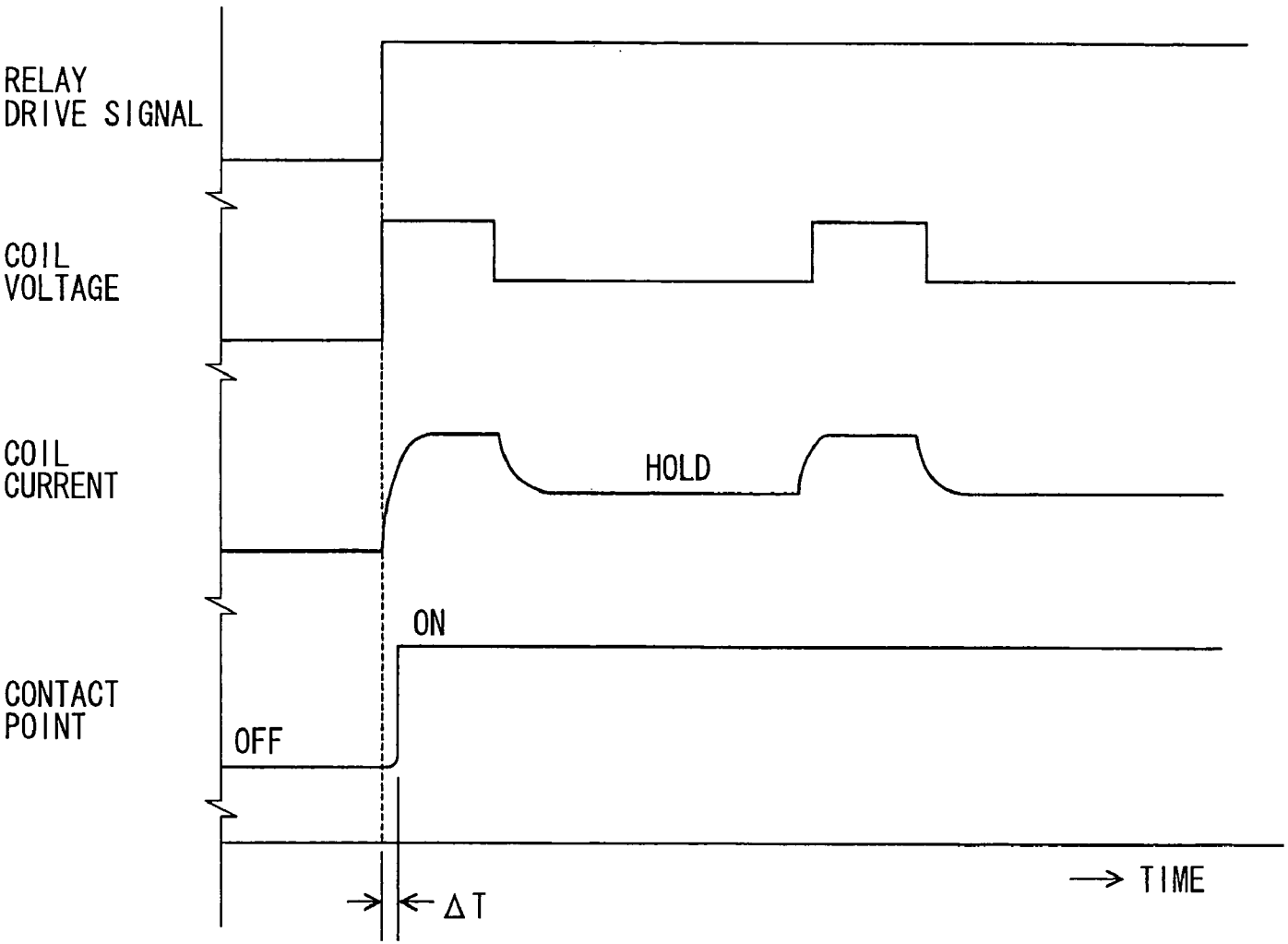
FIG. 5 is a timing chart showing an operation of the relay device according to the embodiment.

Next, the control operation of one relay unit 22 of the relay device 2 will be described with reference to the timing chart of FIG. 5. The operation of the step circuit 42 is not associated with this embodiment, and thus the description thereof is omitted. The control operation of the other relay units 22 is the same as described below.

A digital signal input to the serial signal input terminal 37 of the relay device 2 is interpreted by the communication interface circuit 40, and the communication interface circuit 40 drive controls the operation of each relay unit 22 as follows. When interpreting an ON-instruction of some timer counter 41 of a relay unit 22, the communication interface circuit 40 instructs start of counting operation of the timer counter 41 of the corresponding relay unit 22, and simultaneously turns on a transistor through an OR circuit, whereby the driver transistor 44 for coil driving starts supply of current to the coil 34 of the corresponding relay unit 22 at a rated voltage.

When a predetermined delay time which is set in the timer counter 41 so as to be longer than the time needed until the contact point operation of the relay unit 22 is completed elapses, the timer counter 41 turns off the transistor T, and also instructs the current stabilizing circuit portion 43 so that predetermined constant current smaller than the supply current value which flows in the driver transistor 44 for driving the coil till this moment is made to flow in the driver transistor 44. Accordingly, the current stabilizing circuit portion 43 keeps the emitter current of the driver transistor 44 for driving the coil to the predetermined constant current.

This constant current is set to a value which is slightly larger (for example, by several percentages to about 10 percentage) than the minimum value at which the contact point state of the relay unit 22 can be kept. Accordingly, constant holding current having proper magnitude is supplied to the coil 34, and the power consumption and the coil heating can be effectively reduced while the corresponding relay unit 22 keeps the contact point state.

Subsequently, the timer counter 41 carries out a refreshing operation of turning on the transistor T for only a predetermined short time every time a predetermined time elapses. A rated current is supplied to the coil 34 for only the predetermined short time. This predetermined short time is set so that the contact point state can be changed.

Accordingly, even when the contact state is varied by the input of an unexpected mechanical impact to the relay unit 22 or the like, the contact point state can be restored to the original state by the refreshing operation. Thus, the holding current can be reduced even when the variation of the contact point state is likely to be caused by an occurrence of such an unexpected mechanical impact.

The current stabilizing circuit portion 43 may be, for example, a well-known constant current circuit in which a temperature signal is detected on the basis of a voltage drop achieved by applying a constant voltage to a thermistor or a resistance element having the same temperature variation characteristic as the coil 34. An output current is then subjected to feedback control by using the temperature signal thus detected to achieve a constant current.

Furthermore, by the heating reducing effect of this embodiment, the plural relay units 22 and the control circuit 23 can be integrated in a compact size while suppressing temperature increase caused by a synergetic effect of the heating of respective parts.

(First Modification)

Figure 6:
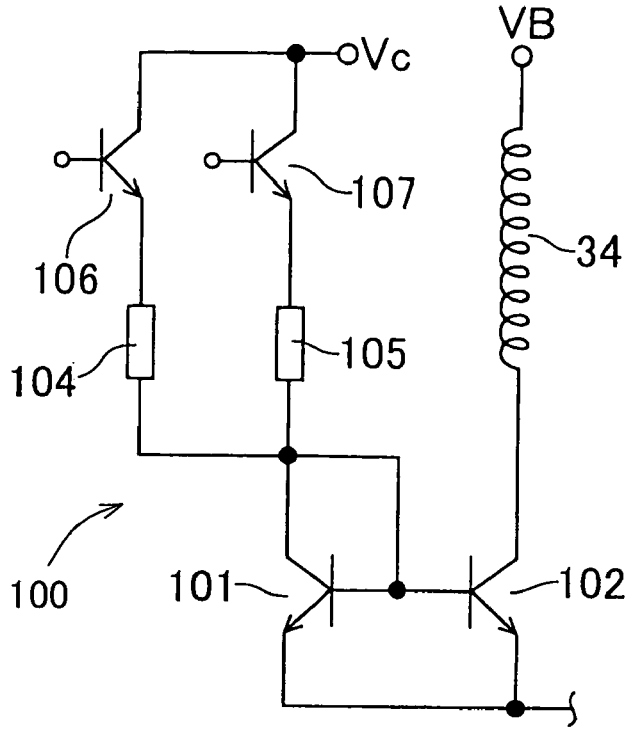
FIG. 6 is a circuit diagram showing a first modification of the relay device according to the embodiment.

As shown in FIG. 6, a circuit for holding the coil current includes a mirror circuit 100. This mirror circuit 100 comprises a first transistor 101 and a second transistor 102, collector resistors 104, 105 of the first transistor 101, and control transistors 106, 107. A power source voltage (battery voltage) VB is applied through the coil 34 to the collector electrode of the second transistor 102. A constant power source voltage Vc is applied to the transistors 106 and 107.

When the control transistors 106 and 107 are turned off, no base current flows through the second transistor 102 corresponding to the driver transistor for driving the coil, and current supply to the coil 34 is set to OFF. When the control transistor 106 is turned on, large current flows in the mirror circuit 100 with a small resistance of the collector resistor 104. The second transistor 102 serving as the driver transistor for driving the coil carries out a saturation operation. Therefore, the collector electrode of the second transistor 102 is substantially grounded to the earth. Thus, the coil 34 is turned on with a rated voltage.

When the control transistor 106 is turned off and the control transistor 107 is turned on, the holding current corresponding to mirror current, which is a square of the current of the first transistor 101, flows through the second transistor 102 into the coil 34 with a large resistance of the collector resistor 105 connected to the control transistor 107. The collector resistor 105 is formed of material having small temperature variation. According, a holding current which is stable to temperature variation can be supplied to the coil 34.

(Second Modification)

Figure 7:
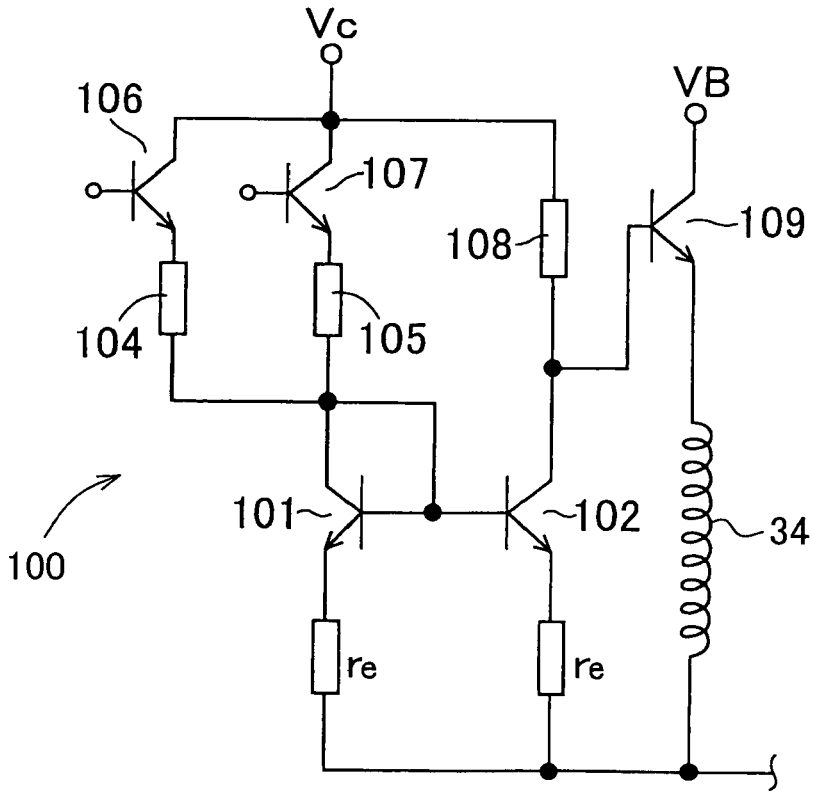
FIG. 7 is a circuit diagram showing a second modification of the relay device according to the embodiment.

A circuit for making the holding current of the coil 34 constant or reducing a temperature-dependent variation may be constructed as shown in FIG. 7. This circuit has a resistor 108 as a collector load of the second transistor 102 of the mirror circuit 100 in the circuit shown in FIG. 6. It further has an emitter follower transistor 109 as a driver transistor for driving the coil 34. A connection-point potential between the resistor 108 and the second transistor 102 is applied to the base electrode of the emitter follower transistor 109.

When the control transistors 106 and 107 are turned on, the second transistor 102 carries out the saturation operation with a large base current of the second transistor 102. Therefore, the emitter follower transistor 109 (used as the driver transistor 44 for driving the coil 34) is turned off, and current supply to the coil 34 is turned off. When the control trasistors 106 and 107 are turned off, the emitter follower transistor 109 (used as the driver transistor 44 for driving the coil 34) is driven through the collector resistor 108, and the coil 34 is turned on at a rated voltage.

When the control transistor 106 is turned off and the control transistor 107 is turned on, the holding current corresponding to mirror current, which is a square of the current of the first transistor 101, flows through the second transistor 102 into the collector resistor 108 with the large resistance of the collector resistor 105 connected to the control transistor 107. As a result, a voltage achieved by subtracting the voltage drop Δ of the collector resistor 108 and the voltage drop ΔVbe of the emitter-follower transistor 109 from the power source voltage VB is applied to the coil 34. Here, the resistance-temperature characteristic of the collector resistor 105 is set to be identical to that of the coil 34, and the collector resistor 108 is designed so that the resistance thereof is little varied with temperature.

When temperature rises, the voltage drop is increased by an increase of the resistance of the collector 105, so that the current of the first transistor 101 is reduced and the collector current of the second transistor 102 is also reduced. Accordingly, the voltage drop of the collector resistor 108 is reduced, the base potential of the emitter follower transistor 109 is increased, and the applied voltage to the coil 34 is increased. Accordingly, even when the resistance of the coil 34 is increased by an increase in the temperature, variation of the current supplied to the coil 34 is suppressed.

(Third Modification)

Figure 8:
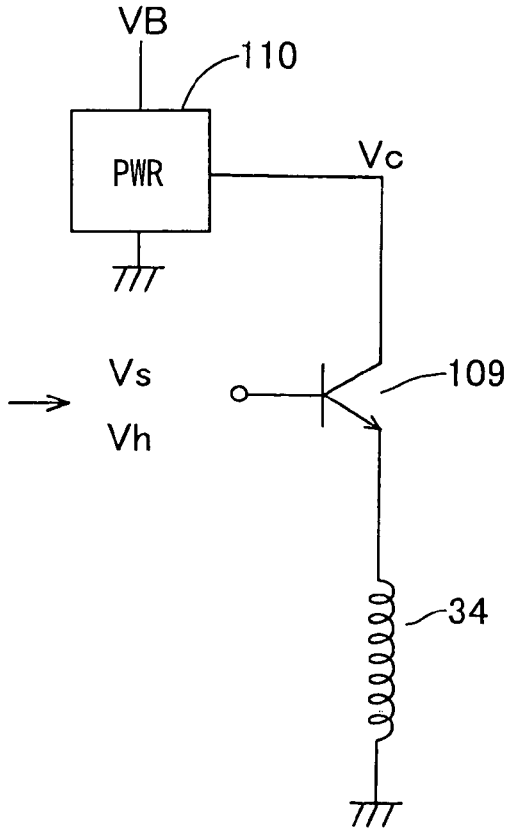
FIG. 8 is a circuit diagram showing a third modification of the relay device according to the embodiment.

Another circuit for making the holding current of the coil 34 constant or reducing temperature-dependent variation of the holding current is shown in FIG. 8.

This circuit supplies current from a power supply circuit 110 through an emitter-follower transistor 109 to the coil 34. A large potential Vs is applied to the base electrode of the emitter-follower transistor 109 at the contact point operation time. When the contact point state is held, a holding voltage Vh smaller than the potential Vs by a predetermined rate is applied to the base electrode.

The power supply circuit 110 is designed so that the output voltage Vc is varied substantially in proportion to the temperature. The power supply circuit 110 is disposed adjacent to the coil 34. Accordingly, the variation of the holding current of the coil 34 due to the temperature variation of the coil 34 can be suppressed. Thus, the power supply circuit 110 limits the holding current.

(Fourth Modification)

For making the holding current of the coil 34 constant or reducing the temperature-dependent variation of the holding current, the circuit shown in FIG. 8 may have a resistor of low resistance connected to the coil 34 in series for detecting current. The resistance-temperature variation of this current detecting resistor is set to be small. The output voltage of the power supply circuit 110 of FIG. 8 is determined in proportion to the voltage drop of the current detecting resistor.

Accordingly, even when the power supply circuit 110 and the coil 34 are away from each other, the holding voltage to the coil 34 can be surely varied in accordance with the temperature-dependent resistance variation of the coil 34. Thus, the holding current to be supplied to the coil 34 can be made constant. The holding current of the coil 34 may be made constant by using other various well-known constant current circuits or temperature detecting feedback circuits.

(Fifth Modification)

For making the holding current of the coil 34 constant or reducing the temperature-dependent variation of the holding current, the circuit shown in FIG. 8 may be constructed as follows.

Specifically, the voltage drop between the base and emitter of the emitter follower transistor 109 which is applied to the coil 34 is compared with a predetermined reference voltage value, and the feedback control is executed. If the former is larger than the latter, the emitter follower transistor 109 is turned off. If the former is smaller than the latter, the emitter follower transistor 109 is turned on.

The voltage drop between the base and emitter of the emitter follower transistor 109 has an exponential relationship with the emitter current. Thus, the supply current to the coil 34 can be prevented from being affected by the resistance variation of the coil 34 caused by the temperature increase. This modification has an advantage that the resistor of low resistance for detecting current can be omitted.

(Sixth Modification)

The holding current of other relays in the relay box, such as the relays 3 and 4 out of the relay device 2, can be stabilized by using each of the constant current circuits and the holding current limiting circuit.

(Seventh Modification)

Figure 9:
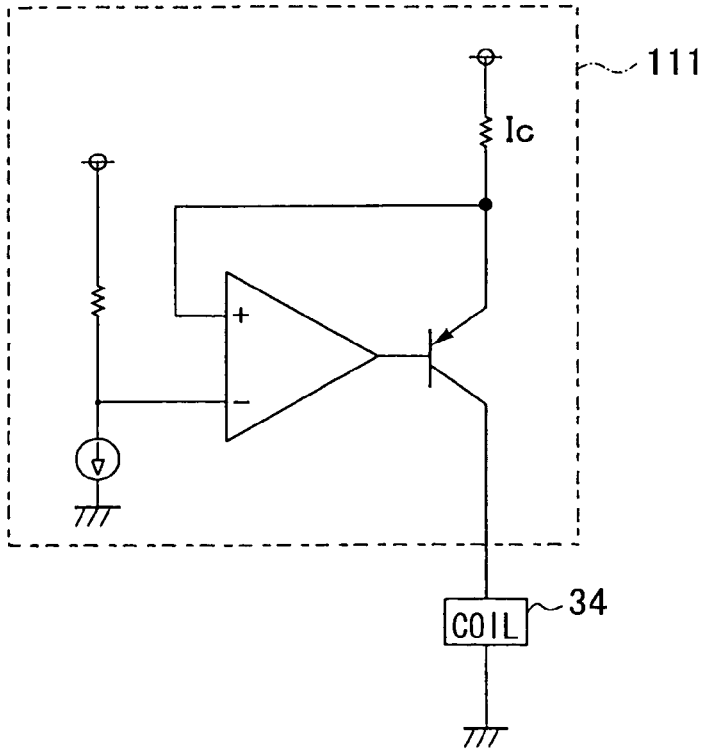
FIG. 9 is a circuit diagram showing a seventh modification of the relay device according to the embodiment.

For making the holding current of the coil 34 constant, a constant current circuit 111 may be connected to the high side of the coil 34 as shown in FIG. 9.

(Eighth Modification)

Figure 10:
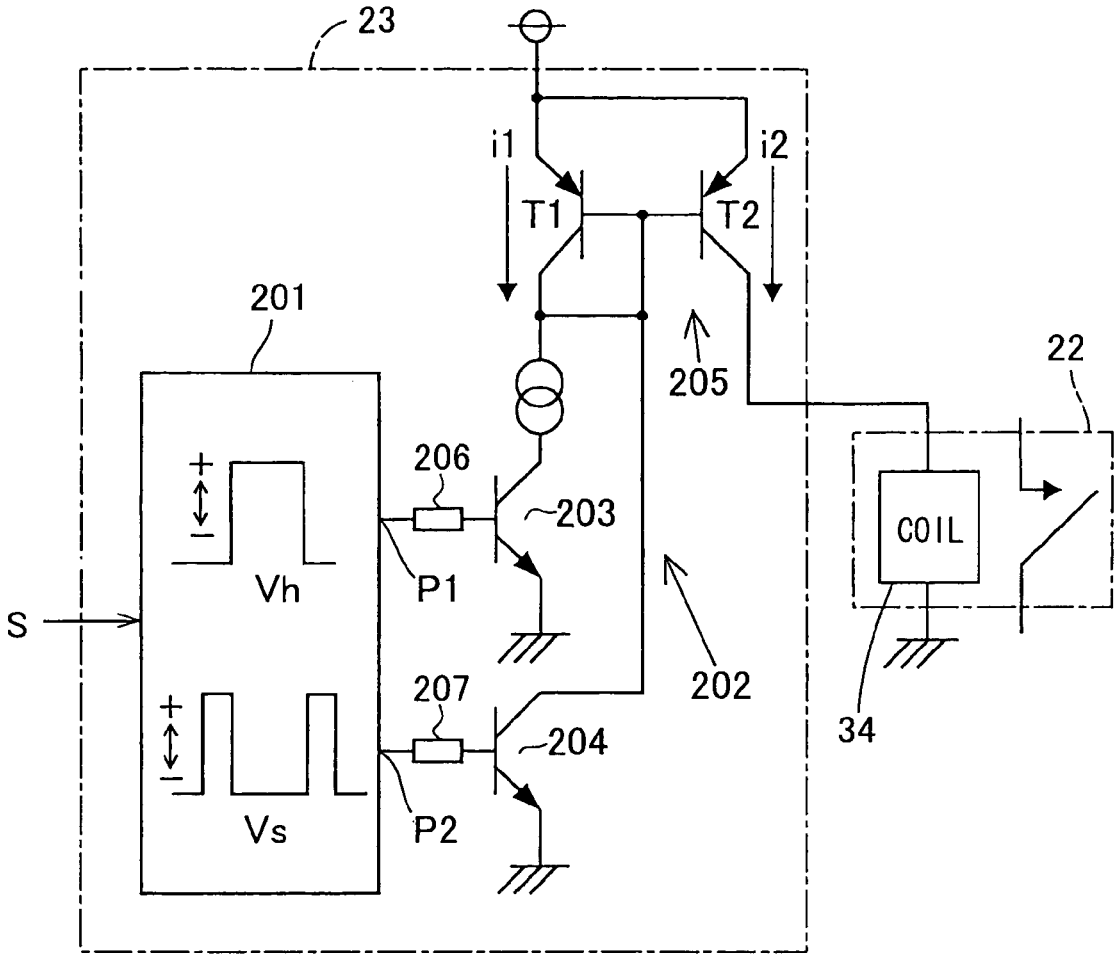
FIG. 10 is a circuit diagram showing an eighth modification of the relay device according to the embodiment.

The control circuit 23 may be constructed to supply a small constant holding current and a large contact point operating current to the relay 22 as shown in FIG. 10.

The control circuit 23 comprises a pulse generator 201, and a current output circuit 202, which is controlled by the pulse generator 210, to control a current to be supplied to the coil 34 of the relay unit 22. The pulse generator 201 outputs a pulse voltage Vh for holding and a pulse voltage Vs for contact point operation in accordance with the potential level of a relay opening/closing signal S input from the external part through a serial line.

More specifically, when the relay opening/closing signal S is varied from low level to high level, a first contact point operating pulse voltage Vs is output to a second output terminal P2. Then the contact point operating pulse voltage Vs is output to the second output terminal P2 every fixed time.

Furthermore, the pulse generator 201 outputs to a first output terminal P1 a holding pulse voltage Vh which is set to high level, after the first contact point operating pulse voltage Vs is output to the second output terminal P2 and when the contact point operating pulse voltage Vs is set to low level. Of course, when the relay opening/closing signal S is set to low level, the pulse generator 210 outputs the low level signal to the first output terminal P1 and the second output terminal P2.

The current output circuit 202 has transistors 203 and 204, a current mirror circuit 205 and resistors 206, 207 for limiting base currents of the transistors 203, 204. The collector of a transistor T2 for output of the current mirror circuit 205 is connected to one end of the coil 34. When the potential of the second output terminal P2 of the pulse generator 201 is set to a high level, the transistor 204 is turned on, and the output transistor T2 of the current mirror circuit 205 is turned on. Thus, a large voltage, with which the contact point can be set to ON state, is applied to the coil 34 of the relay unit 22, and the relay unit 22 is turned on.

Thereafter, when the transistor 204 is turned off and the first output terminal P1 of the pulse generator 201 is set to the high level, current flows in a transistor T1 for reference of the current mirror circuit 205, and the current equal to the above current flows into the output transistor T2. Thus, the supply current to the coil 34 is kept to a small constant value to the extent that the contact point state can be held.

In the actual manufacturing, the output transistor T2 is constructed by connecting in parallel many transistors each having the same size as the reference transistor T1. Accordingly, under the relay holding state, it can be prevented that the power consumption of the current supply circuit 23 is increased by the reference current i1.

The present invention should not be limited to the above embodiment and modifications, but may be modified in many other ways without departing from the spirit of the invention.

What is claimed is:

1. A relay device comprising:

a power supply circuit for supplying a constant voltage;

a relay unit having a coil for opening/closing a contact point;

a driver transistor connected in series with the power supply circuit and the coil; and a control circuit for controlling the driver transistor to control a current supply to the coil, wherein the control circuit is constructed to turn on the driver transistor to apply the constant voltage to the coil to start a contact point operation of the contact point, wherein the control circuit has a holding current stabilizing and limiting circuit for controlling a holding current as a supply current to the coil of the relay unit after the contact point operation based on the constant voltage to the coil is completed so that the holding current is kept to a predetermined constant value, which is smaller in value than an operating current, which flows as the supply current to the coil when the contact point operation is being carried out by the constant voltage, and is larger than a minimum holding current value, which is necessary to hold a contact point state after the contact point operation, and wherein the control circuit has a refreshing circuit for periodically supplying the constant voltage to the coil in place of the holding current while the holding current is supplied to the coil.

2. A method of controlling a relay unit having a coil for actuating a contact point from a normal state to a predetermined operation state by a driver switch connected in series relation to the coil, the method comprising:

controlling the driver switch to a first mode to actuate the contact point from the normal state to the predetermined operation state;

continuously controlling, after the first mode, the driver switch to a second mode to hold the contact point in the predetermined operation state with a holding current, which is limited to a predetermined minimum value necessary to hold the predetermined operation state; and periodically controlling, in the second mode, the driver switch to a third mode to refresh a state of the contact point with a refreshing current, which is larger than the holding current, the refreshing current being sufficient to secure restoration of the predetermined operation state in an event that the contact point has returned to the normal state in the second mode.

3. The method according to claim 2, wherein the controlling the driver switch to a first mode turns on the driver switch so that the driver switch supplies a rated voltage to the coil thereby supplying to the coil a current, which is dependent on the rated voltage and is larger than the holding current.

4. The method according to claim 3, wherein the controlling the driver switch to a first mode limits a supply of the rated voltage to the coil to a predetermined period.

5. The method according to claim 3, wherein the periodically controlling turns on the driver switch for only a limited time period so that the driver switch supplies the rated voltage to the coil and the current larger than the holding current flows in the coil in place of the holding current.

6. The method according to claim 3, wherein the continuously controlling varies the holding current in correspondence with a parameter related to a temperature of the coil.

* * * * *